US007586273B2

(12) United States Patent
Curran

(10) Patent No.: US 7,586,273 B2
(45) Date of Patent: Sep. 8, 2009

(54) METHOD AND APPARATUS FOR ACHIEVING PERCEIVED LIGHT MIXING VIA ALTERNATING DIFFERENT COLORED LEDS

(75) Inventor: John W. Curran, Lebanon, NJ (US)

(73) Assignee: Dialight Corporation, Farmingdale, NJ (US)

( * ) Notice: Subject to any disclaimer, the term of this patent is extended or adjusted under 35 U.S.C. 154(b) by 143 days.

(21) Appl. No.: 11/673,294

(22) Filed: Feb. 9, 2007

(65) Prior Publication Data

US 2007/0183161 A1 Aug. 9, 2007

Related U.S. Application Data

(60) Provisional application No. 60/771,796, filed on Feb. 9, 2006.

(51) Int. Cl.
*H05B 37/02* (2006.01)

(52) U.S. Cl. ..... 315/291; 315/308; 315/312; 315/360

(58) Field of Classification Search ..... 315/246, 315/247, 291, 294, 307, 360, 363, 308, 312; 362/458

See application file for complete search history.

(56) References Cited

U.S. PATENT DOCUMENTS

| | | | | |
|---|---|---|---|---|
| 2004/0155609 | A1* | 8/2004 | Lys et al. | 315/292 |
| 2005/0212459 | A1* | 9/2005 | Patel et al. | 315/291 |
| 2006/0022614 | A1* | 2/2006 | Young | 315/294 |
| 2007/0052375 | A1* | 3/2007 | Lin et al. | 315/312 |
| 2007/0145915 | A1* | 6/2007 | Roberge et al. | 315/312 |
| 2007/0188427 | A1* | 8/2007 | Lys et al. | 345/82 |

* cited by examiner

*Primary Examiner*—David Hung Vu
*Assistant Examiner*—Tung X Le

(57) ABSTRACT

A method and apparatus for achieving perceived light mixing via alternating colored light emitting diodes (LEDs) is disclosed. For example, a control signal to produce a requested color output is received. Then a timing sequence for at least two different colored LEDs to achieve the requested color output is determined. Then the at least two different colored LEDs are activated in an alternating fashion such that the requested color output is observed.

20 Claims, 2 Drawing Sheets

METHOD AND APPARATUS FOR ACHIEVING PERCEIVED LIGHT MIXING VIA ALTERNATING DIFFERENT COLORED LEDS

RELATED APPLICATIONS

This application claims priority under 35 U.S.C. §119(e) to U.S. provisional patent application Ser. No. 60/771,796, filed on Feb. 9, 2006, which is hereby incorporated by reference in its entirety.

BACKGROUND OF THE INVENTION

1. Field of the Invention

The present invention generally relates to a light source, and more particularly to a light-emitting diode (LED) based lighting. The present invention provides a method and apparatus for achieving perceived light mixing via alternating colored LEDs.

2. Description of the Related Art

The use of light emitting diodes (LEDs) to provide illumination lighting has expanded greatly in recent years, particularly with the advent of high flux LEDs. With the size of the LED light sources so small, the ability to provide unique solutions to packaging issues associated with illumination is greatly expanded. Particularly in the areas of architectural, theatrical and landscape lighting, the ability to provide high intensity illumination with LED sources provides great flexibility in the area of packaging.

One potential disadvantage is that driver electronics (also known as power supplies) tend to take up a large volume of many light sources. This puts a restriction on the size of products which can be produced. Moreover, the multiple driver electronics may increase costs.

Therefore, there is a need in the art for an improved method and apparatus for achieving perceived light mixing via alternating different colored LEDs.

SUMMARY OF THE INVENTION

In one embodiment, the present invention provides a light apparatus. For example, the light apparatus comprises a master controller, a pulse duration and/or amplitude controller coupled to said master controller and a driver coupled to said pulse duration and/or amplitude controller and at least two different colored light emitting diodes (LEDs). The at least two different colored LEDs are activated in an alternating fashion in accordance with a frequency of a timing sequence such that only one of said at least two different colored LEDs is powered on at a time such that a receptive sensor perceives the requested color output.

In another embodiment, the present invention provides a method of achieving a perception of a desired color output using at least two different colored LEDs. The method comprises receiving a control signal to produce a requested color output. Then a timing sequence of said at least two different colored LEDs is determined to achieve said requested color output. Subsequently, a first one of said at least two different colored LEDs is activated to output a first color. Thereafter, the first one of said at least two different colored LEDs is deactivated and a second one of said at least two different colored LEDs is activated to output a second color after deactivating said first one of said at least two different colored LEDs in accordance with a frequency of said timing sequence such that said requested color output is observed.

In yet another embodiment, the present invention provides another method of achieving a perception of a desired color output using at least two different colored LEDs. The method comprises receiving a control signal to produce a requested color output. Then a timing sequence of said at least two different colored LEDs is determined to achieve said requested color output. Subsequently, said at least two different colored LEDs are activated in an alternating fashion in accordance with a frequency of said timing sequence to output two different colors in a same direction, such that each one of said at least two different colored LEDs are never activated simultaneously and said requested color output is observed.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

It is to be noted, however, that the appended drawings illustrate only exemplary embodiments of this invention and are therefore not to be considered limiting of its scope, for the invention may admit to other equally effective embodiments.

DETAILED DESCRIPTION

Figure 1:
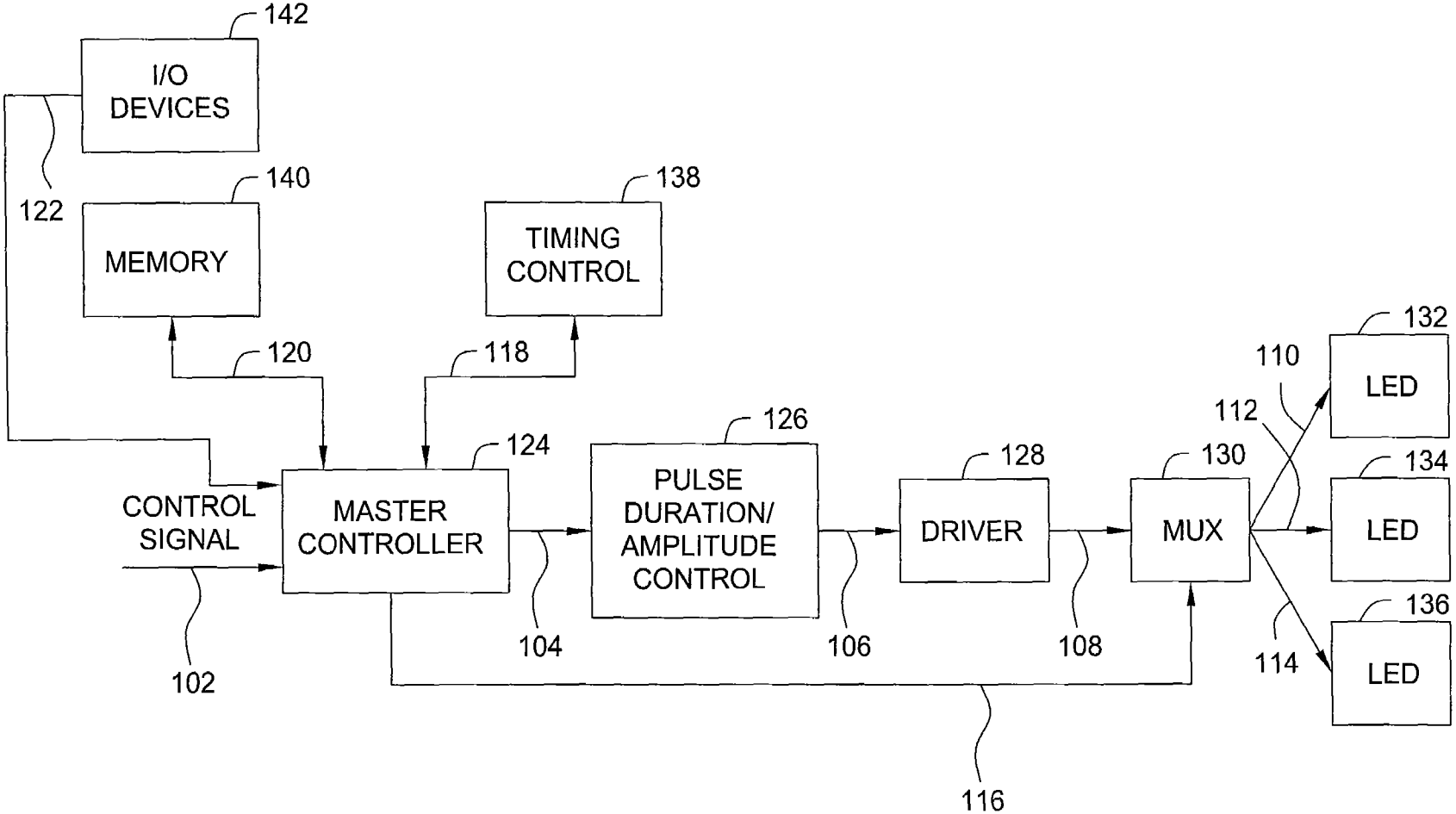
FIG. 1 illustrates an exemplary block diagram of a light apparatus according to one embodiment of the present invention.

FIG. 1 illustrates an exemplary block diagram of a light apparatus 100 according to one embodiment of the present invention. Light apparatus 100 may comprise a master controller 124. Master controller 124 may receive a control signal via input 102. The control signal may be, for example, a request to produce a color output. Master controller may include a processor (not shown) for processing the received control signal.

Master controller 124 may be coupled to a timing controller or a timing circuit 138 via connection 118, a memory 140 via connection 120 and/or input/output devices 142 via connection 122. Memory 140 may be any type of memory storage device for storing data such as, for example, random access memory (RAM) and/or read only memory (ROM).

In an exemplary embodiment, memory 140 may store timing sequences. The timing sequences may be used by the master controller 124 to control the LEDs 132, 134 and 136, as discussed below. For example, the timing sequences may include information or factors such as frequency, illumination periods, illumination intervals and illumination levels for controlling a plurality of different color LEDs to produce a requested color output. In an exemplary embodiment of the present invention, frequency may represent the time interval between a deactivation of a first LED and activation of a second LED or vice versa. Illumination intervals may represent the time interval that an LED stays activated. For example, the time when the LED is activated until the time the LED is deactivated. An illumination period may be the sum of the illumination intervals of each LED required to be activated to achieve the requested color output. An illumination level may represent the brightness, intensity or amplitude of an LED's color output. A requested color output may be achieved by adjusting each one or any combination of each of the factors listed above. The exact values for each one of the factors listed above may be provided by the timing sequences and determined based on the requested color output.

The master controller 124 may determine which timing sequence is needed based upon the requested color output that is to be produced. The timing sequences and how the master controller 124 utilizes the timing sequences will be discussed in further detail below.

Timing controller 138 may be used to provide a clock reference to the master controller 124 to execute the timing sequences stored in memory 140. For example, if a timing sequence calls for an illumination interval of 10 milliseconds, timing controller 138 will provide master controller 124 a way to calculate 10 milliseconds.

Input/output devices 142 may be, for example, storage devices, including but not limited to, a tape drive, a floppy drive, a hard disk drive or a compact disk drive, a receiver, a transmitter, a speaker, a display, a speech synthesizer, an output port, and a user input device (such as a keyboard, a keypad, a mouse, alarm interfaces, power relays and the like). Input/output devices 142 may provide a way for a user to access master controller 124, memory 140 or any other module within light apparatus 100.

Light apparatus 100 may further comprise a pulse duration and/or amplitude controller 126 coupled to master controller 124 via connection 104. Pulse duration and/or amplitude controller 126 may control the illumination periods, illumination intervals and illumination levels of each of the LEDs. The pulse duration and/or amplitude controller 126 adjusts the illumination periods, illumination intervals and illumination levels according to instructions received from the master controller 124 based upon the timing sequence determined for the requested color output to be produced.

Pulse duration and/or amplitude controller 126 may also be coupled to a driver or power supply 128 via connection 106. Driver 128 activates the LEDs 132, 134 and 136 one at a time. Although only a single driver 128 is illustrated, those skilled in the art will recognize the present invention is not limited to a single driver 128. For example, multiple drivers 128 may be used. However, if multiple drivers 128 are used to activate LEDS 132, 134 and 136, only one driver 128 would be powered at any given time such that no two different colored LEDs would ever be activated simultaneously. In an embodiment using multiple drivers 128, the master controller 124 may send a control signal to each one of the multiple drivers 128 to indicate when to power on such that only one driver 128 would be powered at any given time.

In another exemplary embodiment of the present invention, only a single driver 128 is used. Driver 128 may be coupled to a multiplexer 130 via connection 108. Master controller 124 may also be coupled to the multiplexer 130 via connection 116. Master controller 124 may determine which LED to activate based upon the timing sequence. This information may be sent to multiplexer 130 via connection 116. Subsequently, multiplexer 130 may establish the appropriate connection between driver 128 and either LED 132, 134 or 136 via connections 110, 112 and 114, respectively. In parallel, the appropriate LED will be activated in accordance with the timing sequence when driver 128 receives an instruction to activate an LED. With only a single driver 128, only one LED or one bank of LEDs all of the same color may be activated at any given time.

As discussed above, light apparatus 100 may comprise LEDs 132, 134 and 136 coupled to the multiplexer via connections 110, 112 and 114, respectively. Although three LEDs are illustrated in FIG. 1, those skilled in the art will recognize that the present invention is not limited to three LEDs. For example, the present invention may have as few as two LEDs and as many LEDs as desired to achieve any spectrum of color outputs. For example, if LEDs 132, 134 and 134 are red, green and blue, respectively, then the requested output color may only be within the color spectrum created by red, green and blue.

In an exemplary embodiment of the present invention, each one of the LEDs 132, 134 and 136 may each be a different color from one another. However, in an alternate embodiment of the present invention, LEDs 132, 134 and 136 may be banks of multiple LEDs or an array of LEDs of the same color. Notably, in the alternate embodiment, no two different colored banks of multiple LEDs are ever turned on simultaneously. Only one color bank of LEDs of the same color may be powered at any time.

Moreover, LEDs 132, 134 and 136 may be created from any material (e.g. inorganic or organic) suitable for creating LEDs. For example inorganic materials such as aluminum gallium phosphide (AlInGaP) or indium gallium nitride (InGaN) may be used or any organic materials suitable for constructing organic LEDs (OLEDs).

As noted above, the exemplary embodiments of the light apparatus described above is able to produce a requested color output while only activating a single LED of a single color or a bank of multiple LEDs all of the same color at any given time. In other words, no two LEDs of different colors or two banks of LEDs, each bank having a different color, are activated at any given time.

In an exemplary embodiment, production of a requested color output may be achieved by activating each single LED of a single color or a bank of multiple LEDs all of the same color in an alternating fashion with a single LED of a different color or a different colored bank of multiple LEDs all of the same color in the same direction within a frequency of the timing sequence. The LEDs should be positioned such that at least a portion of each output produced by each one of the different colored LEDs overlaps a portion of space within view of a sensor, whether the sensor is a mechanical sensor or the human eye. The frequency should be selected such that an observer or mechanical sensor does not detect that the LEDs are activated in an alternating fashion. In other words, the observer perceives the outputs of the LEDs activated in an alternating fashion, as a continuous light output of the requested color output.

For example, if the requested color output to be produced is yellow, then a red colored LED and a green colored LED would be used by light apparatus 100. An appropriate timing sequence would be determined by master controller 124. The master controller 124 would instruct the driver 128 and multiplexer 130 to activate the red colored LED and green colored LED in an alternating fashion in accordance with the frequency of the timing sequence. The master controller 124 may instruct the pulse duration and/or amplitude controller 126 to adjust the illumination period, illumination interval and illumination level of the red colored LED when activated and the green colored LED when activated to achieve the requested yellow color output. As a result, an observer would not see alternating red and green colored outputs, but rather a continuous light output that is perceived to be yellow.

The human brain has a limited ability to detect instantaneous changes in light intensity. The entire motion picture and television industry is based on the fact that the human brain cannot detect the periods during which the motion picture film frame is changed or the television picture image is repainted. To the human viewer, the image appears to be constantly on and "moving" as each succeeding image gives the illusion of motion of the images contained within.

This principle is exploited by the present invention. The color mixing does not occur physically in space, but rather in the human brain. Alternatively, if the sensor is a mechanical sensor, as discussed above, a processor in communication with the mechanical sensor may be programmed to interpret two different colored light inputs received within a short period of time to be the combination of the two different colored light inputs. The alternating activation of the LEDs must be at a frequency high enough (or a period short enough) that the human visual system cannot distinguish between the different colors of each one of the LEDs activated in an alternating fashion. In an exemplary embodiment, this frequency may be at least 100 hertz (Hz). However, those skilled in the art will recognize that the frequency may need to be tuned as necessary to eliminate the appearance of any flickering when the LEDs are activated in an alternating fashion.

Figure 2:
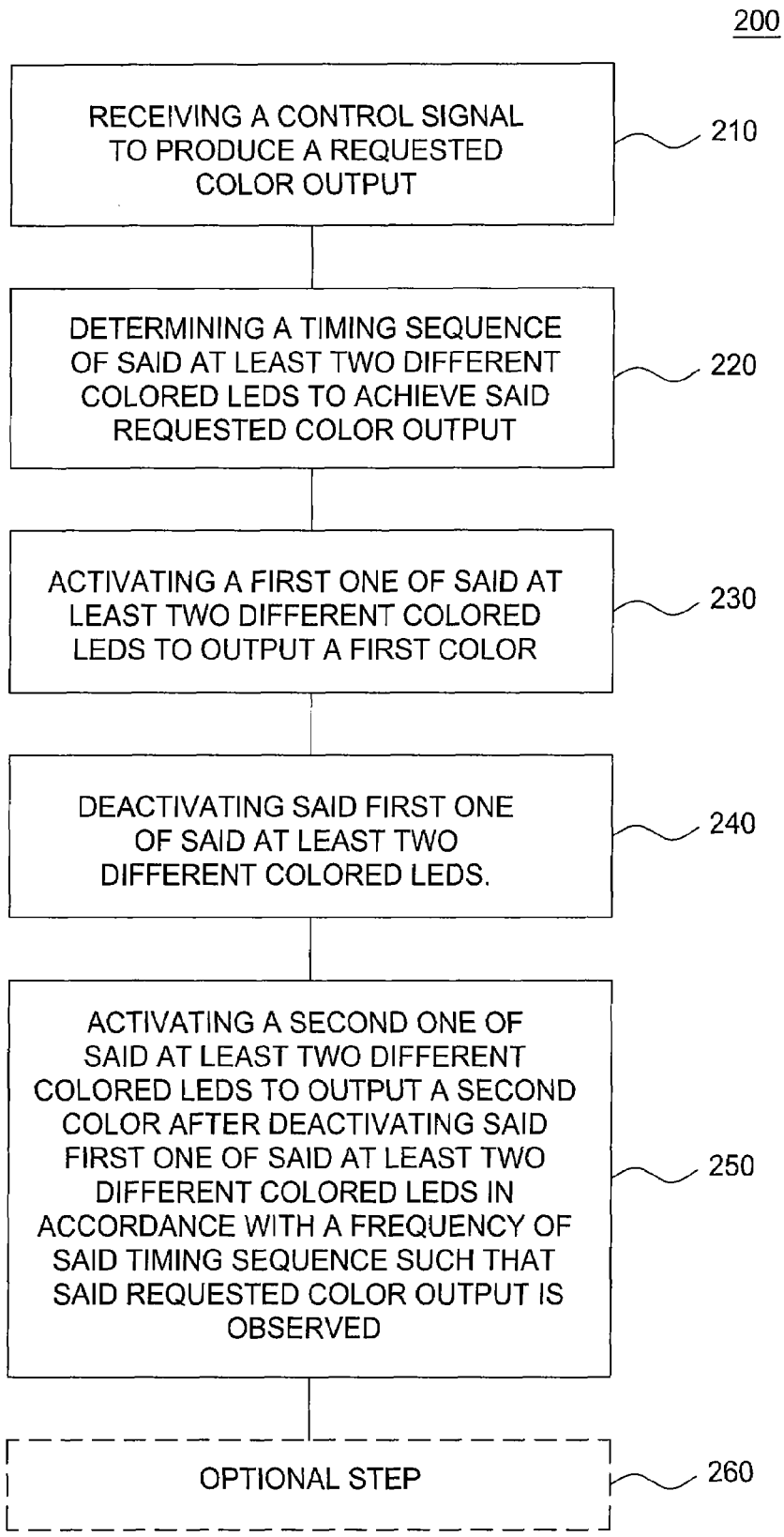
FIG. 2 illustrates a flow chart of an exemplary method of achieving a perception of a desired color output using at least two different colored light emitting diodes (LEDs) as described herein.

FIG. 2 illustrates a flow chart of an exemplary method 200 of achieving a perception of a desired color output using at least two different colored LEDs as described herein. Method 200 begins at step 210 where a control signal to produce a requested color output is received.

At step 220, a timing sequence of at least two different colored LEDs are determined to achieve the requested color output. As discussed above with reference to light apparatus 100, master controller 124 may determine the appropriate timing sequence to use based upon the requested color output and retrieve the timing sequence from memory 140. In other words, in one embodiment, various timing sequences for various colors are predefined and stored in the memory 140.

At step 230, a first one of the at least two different colored LEDs is activated to output a first color. As discussed above, the illumination interval and illumination level of the first one of the at least two different colored LEDs may be determined by the timing sequence and controlled by pulse duration and/or amplitude controller 126.

At step 240, the first one of the at least two different colored LEDs is deactivated. Subsequently at step 250, a second one of the at least two different colored LEDs is activated to output a second color after deactivating the first one of the at least two different colored LEDs in accordance with a frequency of the timing sequence such that the requested color output is observed. Similar to step 230, the illumination interval and illumination level of the second one of the at least two different colored LEDs may be determined by the timing sequence and controlled by pulse duration and/or amplitude controller 126.

Moreover, as discussed above, the frequency should be selected such that all activation and deactivation steps are indistinguishable to a human visual system and appear to be continuously illuminated. For example, the frequency may be at least 100 Hz. As also discussed above, the first and second light outputs should be directed in the same direction such that at least a portion of the first color output when the first LED is activated overlaps a portion of space that will be occupied by at least a portion of the second color output when the second LED is activated and vice versa.

In addition, method 200 may comprise an optional step 260. Optional step 260 may comprise deactivating the second one of the at least two different colored LEDs and subsequently activating at least one additional LED to output a third color after deactivating the second one of the at least two different colored LEDs. Similar to step 250, the at least one additional LED would be activated in accordance with the frequency of the timing sequence such that the requested color output is observed. Furthermore, the at least one additional LED may be a different color than each one of the two different colored LEDs.

The above activation and deactivation steps may be repeated for a desired duration according to the timing sequence. For example, if the requested color output to be produced is to stay on for 10 seconds, then the LEDs may be activated in an alternating fashion by executing the above described activating and deactivating steps for the 10 second duration. The total duration time may also be information that is part of the timing sequences stored in memory 140.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

The invention claimed is:

1. A light apparatus, comprising:

a master controller for receiving a control signal requesting a color output and determining a timing sequence to achieve said requested color output;

a pulse controller coupled to said master controller; and a driver coupled to said pulse controller and at least two different colored light emitting diodes (LEDs), wherein said at least two different colored LEDs are activated in an alternating fashion in accordance with a frequency of said timing sequence such that only one of said at least two different colored LEDs is powered on at a time such that a receptive sensor perceives the requested color output.

2. The light apparatus of claim 1, comprising:

a multiplexer coupled to said driver and said at least two different colored LEDs such that said driver activates only one of said two different colored LEDs at a time.

3. The light apparatus of claim 1, comprising:

a memory coupled to said master controller for storing timing sequences.

4. The light apparatus of claim 1, comprising:

a timing controller coupled to said master controller for providing a clock reference to said master controller.

5. The light apparatus of claim 1, wherein said predetermined frequency is at least 100 hertz.

6. The light apparatus of claim 1, comprising:

at least one additional LED coupled to said driver, wherein said at least one additional LED is a different color than each one of said at least two different colored LEDs.

7. The light apparatus of claim 1, wherein said pulse controller controls an illumination interval and an illumination level of an activated one of said at least two different colored LEDs.

8. The light apparatus of claim 1, wherein said receptive sensor comprises a mechanical sensor.

9. The light apparatus of claim 1, wherein said receptive sensor comprises a human eye.

10. A method of achieving a perception of a desired color output using at least two different colored light emitting diodes (LEDs), comprising:

receiving a control signal to produce a requested color output;

determining a timing sequence of said at least two different colored LEDs to achieve said requested color output;

activating a first one of said at least two different colored LEDs to output a first color;

deactivating said first one of said at least two different colored LEDs; and activating a second one of said at least two different colored LEDs to output a second color after deactivating said first one of said at least two different colored LEDs in accordance with a frequency of said timing sequence such that said requested color output is observed and such that only one of said at least two different colored LEDs is powered on at a time such that a receptive sensor perceives said requested color output.

11. The method of claim 10, comprising:

deactivating said second one of said at least two different colored LEDs;

activating said first one of said at least two different colored LEDs to output said first color after deactivating said second one of said at least two different colored LEDs in accordance with said frequency of said timing sequence such that said requested color output is observed; and repeating all of said activating and deactivating steps for a desired duration according to said timing sequence.

12. The method of claim 10, comprising deactivating said second one of said at least two different colored LEDs;

activating at least one additional LED to output a third color after deactivating said second one of said at least two different colored LEDs in accordance with said frequency of said timing sequence such that said requested color output is observed, wherein said at least one additional LED is a different color than each one of said at least two different colored LEDs; and repeating all of said activating and deactivating steps for a desired duration according to said timing sequence.

13. The method of claim 10, wherein said frequency is selected such that all of said activation and deactivation steps are indistinguishable to a human visual system and appear to be continuously illuminated.

14. The method of claim 10, wherein said frequency is at least 100 hertz.

15. The method of claim 10, wherein said first and second color outputs are directed in the same direction such that at least a portion of said first color output overlaps a portion of space that will be occupied by at least a portion of said second color output when said second LED is activated.

16. The method of claim 10, wherein activating said first one of said at least two different colored LEDs comprises a first illumination interval and a first illumination level and activating said second one of said at least two different colored LEDs comprises a second illumination interval and a second illumination level.

17. The method of claim 16, comprising an illumination period, wherein said illumination period is a sum of said first and second illumination intervals.

18. The method of claim 16, wherein said first and second color outputs may be adjusted such that said requested color output is observed by adjusting any combination of said first and second illumination intervals and illumination levels.

19. A method of achieving a perception of a desired color output using at least two different colored light emitting diodes (LEDs), comprising:

receiving a control signal to produce a requested color output;

determining a timing sequence of said at least two different colored LEDs to achieve said requested color output; and activating said at least two different colored LEDs in an alternating fashion in accordance with a frequency of said timing sequence to output two different colors in a same direction, such that each one of said at least two different colored LEDs are never activated simultaneously and said requested color output is observed.

20. The method of claim 19, comprising:

activating at least one additional LED with said at least two different colored LEDs in an alternating fashion within a frequency in accordance with said timing sequence, wherein said at least one additional LED is a different color than each one of said at least two different colored LEDs.

* * * * *